US008446323B2

(12) United States Patent
Weidmann et al.

(10) Patent No.: US 8,446,323 B2
(45) Date of Patent: May 21, 2013

(54) RADAR ANTENNA ARRAY

(75) Inventors: Wolfgang Weidmann, Schwarzach (DE); Robert Mock, Traustadt (DE)

(73) Assignee: InnoSenT GmbH, Donnersdorf (DE)

( * ) Notice: Subject to any disclaimer, the term of this patent is extended or adjusted under 35 U.S.C. 154(b) by 512 days.

(21) Appl. No.: 12/454,013

(22) Filed: May 11, 2009

(65) Prior Publication Data

US 2009/0284440 A1 Nov. 19, 2009

(30) Foreign Application Priority Data

May 9, 2008 (DE) ..... 10 2008 023 030

(51) Int. Cl.
*H01Q 1/38* (2006.01)

(52) U.S. Cl.
USPC ..... 343/700 MS; 343/893

(58) Field of Classification Search
USPC ..... 343/700 MS, 844, 824, 893, 825, 343/826, 827, 828
See application file for complete search history.

(56) References Cited

U.S. PATENT DOCUMENTS

| | | | | |
|---|---|---|---|---|
| 4,180,817 | A * | 12/1979 | Sanford | 343/700 MS |
| 5,115,245 | A * | 5/1992 | Wen et al. | 342/175 |
| 5,400,039 | A * | 3/1995 | Araki et al. | 343/700 MS |
| 6,320,542 | B1 * | 11/2001 | Yamamoto et al. | 343/700 MS |
| 6,975,263 | B1 * | 12/2005 | Lovsen | 342/70 |

FOREIGN PATENT DOCUMENTS

GB 2235587 A * 3/1991

* cited by examiner

*Primary Examiner* — Dieu H Duong
(74) *Attorney, Agent, or Firm* — Pandiscio & Pandiscio

(57) ABSTRACT

The invention is directed to a radar antenna array, preferably based on microstrip conductor technology, particularly for a medium to long range radar sensor, comprising at least one first antenna group having a plurality of individual, mutually coupled antenna elements and at least one second antenna group having a plurality of individual, mutually coupled antenna elements, wherein the antenna elements of different antenna groups are not galvanically connected to one another, but are arranged in a common, preferably planar area and in a mutually interlaced manner and can be operated simultaneously.

42 Claims, 2 Drawing Sheets

RADAR ANTENNA ARRAY

The invention is directed to a radar antenna array, preferably based on microstrip conductor technology, particularly for a medium to long range radar sensor, comprising at least one first antenna group having a plurality of individual, mutually coupled antenna elements and at least one second antenna group having a plurality of individual, mutually coupled antenna elements, wherein the individual antenna elements of different antenna groups are not galvanically connected to one another, but are arranged in a common, preferably planar area and in a mutually interlaced manner.

U.S. Pat. No. 7,129,892 B2 discloses a planar antenna having a plurality of antenna areas. The pattern of this antenna can be varied by virtue of the fact that a middle "branch" comprising three antenna areas that are coupled together galvanically or via waveguides can have one or two similar branches selectively coupled in parallel with it. Although the antenna pattern can be influenced in this way, the device nevertheless always remains a single antenna, supplying only one receive signal. The "secondary branches," which may be separate, do not serve as antennas in their own right; each merely has a connector for the application of a dc voltage, by means of which PIN diodes in coupling lines between the branches can be selectively switched, via different dc voltages, to an "on" state (branches connected in parallel) and an "off" state (branches disconnected). If it is necessary to have a transmitting antenna in addition to a receiving antenna—as is inevitably the case in radar applications—then two such antennas, for example, must be placed side by side for this purpose. This, in turn, makes for relatively large spatial requirements, especially since the directional characteristic of an antenna, defined by the 3 dB beamwidth of the main beam in the antenna pattern, is roughly inversely proportional to the particular widthwise extent of the antenna; thus, a good directional characteristic can be obtained only with a sufficiently large antenna area. Due to these interrelationships, in the 24 GHz frequency band the directionality or directional characteristic is limited to 11°×18°.

In many cases, of course, it is possible to use a single antenna sometimes as a transmitting antenna and at other times as a receiving antenna by switching it back and forth, but only if this is permitted by a radar signal with a long transit time. In radar sensor applications, where the distances to be measured are only a few hundred meters or less, this usually is not feasible. A prime example is automotive applications, where, for instance, vehicles traveling in front can be detected by radar.

That being said, it is in precisely this type of application that it is also important for antennas to have a high directional characteristic. In medium to long range radar sensors, i.e., those with a range of about 100 m or more, the combination of transmitting and receiving antenna(s) and their respective available gains are primary determinants of the sensitivity, and thus the range, of the radar. Gain is the ratio of the maximum radiation density of a (lossy) antenna having a preferred direction to the radiation density of an idealized reference antenna transmitting as nondirectionally as possible, i.e., isotropically. Furthermore, there is a mutual dependence between the gain and the directional factor of an antenna. The smaller the aperture angle of an antenna, and thus the more pronounced its directional characteristic, the higher the gain. The aperture of an antenna, i.e., the size of its radiating opening or area, is also related. The larger the aperture, the more pronounced the directional characteristic and the higher the gain. This makes for relatively large dimensions, even with use in the microwave range, where the diameter of the aperture opening or the radiating area can range up to about 10 cm.

On the other hand, in many applications—in the automotive sector, for example, or in industrial applications such as fill level measurement—the maximum size of such a sensor is often dictated by specifications that can be met only with antennas that are no more than about 10 to 12 cm in diameter. The—necessary—combination of a transmitting and a receiving antenna doubles the amount of space occupied, and this is found to be a major disadvantage in many cases.

A possible corrective would be to try using the 77 GHz frequency band instead of the 24 GHz frequency band; but this involves higher costs, for the necessary high-frequency components.

Another way of reducing antenna dimensions would be to use only one antenna and, instead of using switches to change from one mode to the other, instead to separate the incoming from the outgoing signals by means of transmit/receive switches or the like. A circulator is a potential candidate here, but such devices are very expensive and are not compatible with planar technology; another possibility is a so-called power splitter, but these have much poorer technical characteristics. A stronger directionality or directional characteristic than 11°×11° thus cannot be achieved in the 24 GHz range.

From these described disadvantages of the prior art comes the problem initiating the invention, that of optimizing a radar antenna array in such a way that an available area of about 100 to 150 $cm^2$ is sufficient for both the transmitting and the receiving antenna together. Insofar as possible, the array is to be designed so that no expensive ancillary components such as circulators, power splitters, changeover switches, etc., are necessary, so that it can be used in the 24 GHz microwave/ISM frequency band, i.e., at radar frequencies below 70 GHz, and, finally, so that the antennas can be decoupled or isolated from each other as optimally as possible.

This problem is solved, in an antenna array of the above kind, by the fact that the two interlaced antenna groups can be operated simultaneously. This is especially important for radar applications, where reflections of the emitted signals must be received again nearly simultaneously. In addition, simultaneous operation eliminates the need for expensive ancillary components such as circulators, power splitters, changeover switches, etc.

In the context of the present invention, the term "interlaced" is to be understood in the sense that at least one, preferably more than one, antenna element(s) of one group is/are (each) disposed between at least two antenna elements of another group; the converse is preferably also true, i.e., at least one, preferably more than one, antenna elements of the second group is/are surrounded on two mutually approximately opposite sides by at least one respective antenna element of the first group. Such interlacing produces a number of advantages. The aperture or radiating area of an antenna group can be equated to the total area delineated or marked out by the most peripheral antennas of that group, i.e., approximately the area of the entire array, thus allowing the available area of the two (or more) antenna groups to be used to best advantage. Nevertheless, the individual antenna elements can be configured or adjusted individually, particularly with regard to resonance and impedance. The invention describes a way of minimizing crosstalk between immediately adjacent antenna elements or between mutually interlaced antenna groups.

In particular, the invention provides that there is, on the periphery of an antenna group, at least one antenna element whose consumed and radiated transmission power (in transmit mode) or captured and relayed transmission power (in receive mode) is lower, preferably at least 10% lower, particularly at least 15% lower, than the transmission power consumed and radiated or captured and relayed by an antenna element in the interior of that antenna group, particularly in the region of its centroid.

The fact that the power of the individual antenna patch decreases toward the periphery prevents an abrupt drop in radiation power at the edge of an antenna group, which improves the directional characteristic by virtually suppressing side maxima. In the context of radar operations, this makes it possible to obtain much better information on a reflecting object than when there are numerous side maxima, which can falsify the data considerably.

If—as the invention also provides—the first and second antenna groups are each assigned a respective HF receiver module to which the connectors of the respective mutually coupled antenna elements of the particular antenna group are permanently connected, then both antenna groups can be operated simultaneously as receiving antennas.

This has the advantage that two or more receiving antenna groups can be offset laterally from each other and/or can be used with different directional characteristics, with the result that the maximum amount of information can be derived from the reflected radiation, particularly information regarding the position or the deviation angle of a reflecting object.

Particular advantages are gained if the total area of the mutually interlaced antenna groups is approximately equal to the space occupied by the antenna group having the narrowest directional characteristic, taking as the width of the directional characteristic the 3 dB beamwidth of the particular antenna pattern. To obtain a given directional characteristic, an antenna or antenna group has to have certain external dimensions that determine its/their aperture. The antenna with the narrowest directional characteristic requires the largest area, and within the perimeter of this occupied space the invention instead disposes a plurality of antenna groups; hence, the effective space consumption is not increased over that of a single antenna group.

The invention makes it possible to choose the selectivity between two, a plurality or all of the antenna groups as (in each case) equal to or greater than 20 dB. This results in particular from the fact that—as the invention further provides—there are no connections of any kind between different antenna groups, particularly connections made by semiconductor elements or other circuit parts.

It is within the scope of the invention that the different antenna groups are each connected or permanently connected to a common input or output. Each antenna group can thus be operated by means of a single, common electrical input signal or output signal that is easy to generate and analyze, from a circuitry standpoint.

It has proven favorable for the mutually interlaced antenna elements to be arranged in a regular surface pattern. Such a pattern is conducive to uniform superposition of the transmission signals emitted or received by the individual antenna elements.

Further advantages are gained by having successive antenna elements of different antenna groups alternate along at least one spatial direction. This results in antenna rows with approximately equal, preferably approximately gridded, spacings between the individual member antennas of a group. In this way, the total available area that has the most uniform possible transmission power or reception field strength is used to best advantage and thus contributes in its entirety to the aperture area or radiation area.

The invention can be refined by having successive antenna elements of different antenna groups alternate along each of two different spatial directions. This results in antenna arrays with approximately equal, preferably approximately gridded, spacings between the individual member antennas of a group. In this way, the total available area that has the most uniform possible transmission power or reception field strength is used to best advantage and thus contributes in its entirety to the aperture area or radiation area.

The two spatial directions in each of which successive antenna elements of different antenna groups alternate with one another are preferably approximately perpendicular to each other. This yields highly orderly and clear-cut relationships, in which adjacent antenna elements of the same antenna group are always roughly the same distance apart.

It has proven particularly effective if the mutually interlaced antenna elements are arranged in a sort of checkerboard pattern, preferably in such a way that the antenna elements of the first antenna group are placed at the locations occupied by white fields on a checkerboard, whereas the antenna elements of the second antenna group are placed at the locations occupied by black fields[1] on a checkerboard. The individual antenna elements can be packed together especially tightly in this arrangement, in order to make the best possible use of the total available area. Finally, among other things, a mirror-symmetrical or rotationally symmetrical overall arrangement of the antenna elements of an antenna group can be obtained in a simple manner with a pattern of this kind.

[1] Translator's Note: The word "Feld" in German is the standard word for "square" on a checkerboard, but since it is intrinsically more generic than "square," we have used the literal translation.

It is within the scope of the invention that plural fields in the checkerboard pattern are not occupied by antenna elements. Such a measure makes it possible to create a mutual offset between the individual antenna groups, particularly by disposing the unoccupied fields of the checkerboard pattern formed by different antenna groups at mutually diametrically opposite sides or edges of the checkerboard pattern.

A relationship can also be set up between different antenna groups with regard to the positions of the centroids of all the antennas (antenna areas) of each antenna group. In this case, the distance between the centroids should, insofar as possible, be no greater than the distance between two antennas (antenna areas) of the same antenna group that bracket at least one antenna of another antenna group, i.e., in a checkerboard pattern, the nearest antenna of the same antenna group in the same row or column, corresponding, within a column or row of a checkerboard, to the nearest field of the same color. Despite the fact that in a checkerboard pattern having even numbers of rows and columns, i.e., for example eight or ten of each, it is actually possible in this way to create an arrangement in which the centroids of two different antenna groups coincide, in many applications it is desirable for the centroids to have a more or less large offset.

The first and second antenna groups should each be assigned their own HF transmitter module and/or HF receiver module, making it possible for both antenna groups to be operated simultaneously. Simultaneous operation is much more important in radar applications than it is, for example, in the case of radio equipment or the like.

The first and second antenna groups should each preferably be assigned their own receiver module, making it possible for both antenna groups to be operated simultaneously as receiving antennas. By having different directional characteristics and/or a mutual offset, these two receiving antenna groups can supply different types of information regarding an object reflecting radar waves if they are active at the same time.

For the antenna groups to be simultaneously operable, it is beneficial if the connectors of the respective mutually coupled antenna elements of the particular antenna group are permanently connected—i.e., without the insertion of a changeover switch—to the HF transmitter module and/or HF receiver module assigned to them. In cases where a changeover switch is used, a number of antennas usually share the same HF transmitter module or HF receiver module instead of each having their own, and this renders simultaneous operation impossible.

A plurality or preferably all of the antenna elements can be disposed on a plate- or board-shaped substrate. The purpose of this substrate can be, on the one hand, to isolate the antenna elements from other circuit parts, and on the other hand, to provide mechanical support for the antenna elements so that they can be fixed as immovably as possible in a constant grid.

The invention recommends disposing the antenna elements on one side of a flat substrate, particularly a circuit board, on the back of which at least one, preferably both, of the HF transmitter and/or HF receiver modules are located. Distributing the various circuit or antenna components on both flat sides of a flat substrate makes optimum use of the space taken up by the substrate. The space occupied by the array as a whole is thereby reduced to the area needed for the antennas. In addition, placing the circuitry on the back of the board makes it much less disruptive to radio operation than it would be on the front of the board, where the antennas are located.

To couple the antennas to the HF modules, it can be provided to couple at least one, preferably both, of the HF transmitter and/or HF receiver modules to the antenna elements of the particular antenna group by means of, in each case, one more vias passing through the substrate, particularly the circuit board. The contacting can thus be done over short paths, which is conducive to optimum signal flow.

The inventive array lends itself to an implementation in which a plurality or preferably all of the antennas are implemented as antenna areas and/or as planar antennas. Such antennas as commonly referred to as "antenna patches"; they can be fixed over their entire area to a plate- or board-shaped substrate to achieve maximum mechanical stability.

A plurality or preferably all of the antenna patches can each present for example an angular, preferably a rectangular or square, area. For one thing, such an array is suitable for arrangement in a (checkerboard) pattern, with antennas arranged in a constant grid. For another, due to the constant length of such areas, standing waves can be generated optimally on such antennas, thus resulting in a pronounced resonance curve and the ability to sharply limit the transmission and/or reception frequency. Such patches are preferably suitable for linear polarization.

The invention can be refined by having a plurality or preferably all of the antenna patches each present a polygonal, particularly beveled, or even a circular area, particularly an area in the shape of an (irregular) hexagon or of circular shape. Such patches are preferably suitable for circular polarization.

The question of whether the patches should be excited to linear or circular vibration is not of essential significance. It is important, however, that, where applicable, as nearly as possible all the antenna patches vibrate in the same manner and spatial direction, which can be achieved in particular by having the connecting lines of all the patches come at them consistently from the same or, at most, antiparallel spatial directions.

The invention further provides that in each case the areas of two, a plurality or all of the antenna patches are the same size. Since the array as a whole is usually (mirror) symmetrical, in most cases there are two mutually symmetrically arranged antenna areas that are also largely identical in their dimensions. In a true checkerboard pattern, all the areas are actually the same size.

It is further provided within the scope of the invention that the radiated transmission power of the antenna patches decreases continuously from a center of the particular antenna group, particularly from its centroid, to its periphery along at least one spatial direction, preferably along every spatial direction within the area. A steady decrease of this kind serves to prevent abrupt transitions in radiation power at the edges of the antenna groups; this, in turn, brings about a considerable reduction of side maxima in the directional characteristic, leading in turn to more precise analysis of information and more reliable prediction of the exact position of a known object.

An optimal directional characteristic is obtained particularly by having the radiated transmission power of the antenna patch decrease approximately along a cosine or cosine$^2$ curve from a center of the antenna group concerned, particularly from its centroid, to its periphery along at least one spatial direction, preferably along every spatial direction in the area, the zero point of the argument of said curve being located at the center or centroid of the antenna group concerned. Such curves create a maximally smooth transition from a maximum transmission power in the center of an antenna group to the vanishing transmission power outside the antenna group; the accentuation of undesirable side maxima is minimal.

For this purpose, for example, the area of an antenna patch can be made to depend on its position, for example in such a way that the area of an antenna patch becomes smaller, for example linearly or approximately along a cosine or cosine$^2$ curve, from the center of the radar antenna array along at least one spatial direction to its periphery. The area of an antenna patch, particularly its width transversely to a standing wave, is a determinant of its impedance and thus of its radiation intensity.

The width of the antenna patch, measured transversely to its direction of vibration, determines the impedance of the patch concerned, and thus its power consumption and power radiation. Hence, if this width of the antenna patch decreases, for example linearly or approximately along a cosine or cosine$^2$ curve, from a center of the antenna group concerned, particularly from its centroid, to its periphery along at least one spatial direction, preferably along every spatial direction within the area, then the consumed or radiated transmission power behaves accordingly.

In another approach, it is also possible for the power supplied to the antenna patch to be attenuated, for example linearly or approximately along a cosine or cosine$^2$ curve, from a center of the antenna group concerned, particularly from its centroid, to its periphery along at least one spatial direction, preferably along every spatial direction within the area. In this way, because of the low transmission power offered, the peripheral patches are able to consume or radiate less power than comparable patches in the center of the particular antenna group, even given comparable impedance. In transmit mode, the power tapped and relayed to the HF receiver can be reduced or damped in order to obtain a comparable effect in receive mode.

A further option for influencing the consumed and radiated or captured and relayed power is to displace the connector of at least one antenna patch located in the region of the periphery of the particular antenna group to a greater extent relative to the edge circumscribed by the area of the particular antenna patch than the connector of an antenna patch in the interior of the particular antenna group relative to the edge that is circumscribed there. Since the coupling is not as strong in the edge region as it is in a more central region of an antenna patch, peripheral antenna patches that are dimensioned in this way are able to exchange less energy with the connected HF module than antenna patches in the center of the antenna group.

The power delivered to or tapped by the antenna patches can be reduced toward the periphery by means of power splitters in the feed network, preferably according to the ratio of any mutually different wave resistances that may be present in different branches of the feeding or receiving network.

In another approach, it is also possible to reduce the power delivered to or tapped by the antenna patches by means of lambda/4 transformers and/or resistances in specific branches of the feeding or the receiving/tapping network, particularly branches leading to the peripheral antenna patches.

The longitudinal extent of two, a plurality or all of the antenna patches in at least one common spatial direction should be the same. This longitudinal extent is particularly well suited for generating standing resonance waves having the same vibration frequency, and should therefore be in a certain ratio to the wavelength of the preferred radar wave.

To generate a standing wave, it is necessary for the common length of two, a plurality or all of the antenna patches to correspond to roughly half the wavelength of the radiated or sensed radar signals or to a fraction thereof, approximately one-fourth thereof. In the case of an extent that is one-half the vibration wavelength, a vibration node can form at both electrically reflecting ends of an antenna area, i.e., at the mutually opposite end faces, with a vibration antinode between them in each case.

Placing adjacent antenna patches at a suitable distance from each other causes electrical decoupling between the antennas, which preferably are to be assigned to different antenna groups. A minimum distance of at least $\lambda/8$ has proven suitable, where $\lambda$ is the wavelength under vacuum of the radar frequency used.

In particular, two antenna groups that are operated simultaneously as receiving antennas should have an antenna offset in at least one spatial direction, preferably in an approximately horizontal direction, i.e., a distance d between the two antenna centroids of all the antenna elements, particularly antenna patches, in each of the two antenna groups, that is preferably smaller than the total extent of the antenna group having the widest directional characteristic in the spatial direction concerned, taking as the width of the directional characteristic the 3 dB beamwidth of the particular antenna pattern. Such a relatively small offset can be achieved only by interlacing the individual antenna elements.

The mutually interlaced antenna elements according to the invention particularly make it possible to have arrays with a distance d between the two antenna centroids of all the antenna elements, particularly antenna patches, in two antenna groups that is equal to or less than the wavelength $\lambda$:

$$0<d\leqq\lambda.$$

Two, a plurality or all of the flat antenna elements, particularly antenna patches, should be connected at a point between the center and the periphery of an area circumscribed by the particular antenna element, either by means of a via to the point concerned or in the region of an inwardly directed recess in the circumscribed area of the particular antenna element. In these regions, the connection impedance of a patch is in an optimum range for coupling.

It is particularly beneficial to provide a (galvanic) connection between the adjacent antennas of a common antenna group, particularly in the form of a signal propagation line that is equal, for example, to the wavelength of the emitted or sensed radar signals or a multiple thereof, for example twice the wavelength. This signal line then serves as a delay line and ensures that the signals are delivered in phase to the particular antenna elements or antenna patches or are added or superposed in phase onto the (reception) signals coming from them, causing the particular vibrational amplitude to be increased or decreased as a result of the superposition.

If—as the invention further provides—the signal lines used for connection extend on an approximately straight path between the particular antenna elements or antenna patches, then these adjacent and directly interconnected antenna patches should be spaced apart by a predefined, preferably roughly constant distance, which, for example, approximately corresponds to the wavelength of the emitted or sensed radar signals or a multiple thereof, for example twice said wavelength. In such cases, the straight signal line itself causes the desired phase shift of $n\cdot\lambda$.

The feed to two, a plurality or all of the antenna patches of the same antenna group can be effected by galvanic means, particularly by means of waveguides; this method has proven effective with etched circuits, because the connecting lines can then be produced at the same time as the antennas (antenna areas) themselves. Such a line connection, in combination with a (ground) conductive area on the back of the circuit board or board layer concerned, results in a stripline.

In another approach, two, a plurality or all of the antenna elements or antenna patches of the same antenna group can be coupled to one another or to an incoming or outgoing line by way of (in each case) one or more slits. What is crucial here is not so much the technical implementation of the coupling as the degree of coupling. The latter should be as hard as possible, so vibrations or similar disruptions cannot be generated by reciprocal influencing.

An especially simple construction is realized if one or more rows of antenna patches of the same antenna group are connected to one another in the antenna plane itself. Since adjacent antenna elements or antenna areas are preferably assigned to different antenna groups, they must be separated from each other as completely as possible from a signal standpoint, and this is best achieved by placing them a set distance apart. Thus, between adjacent antenna elements or antenna areas there remain unused alleys that are pre-eminently suitable for the integration of connecting lines.

Since a connecting line is usually to be assigned, from a signal standpoint, to one of two adjacent antenna elements or antenna areas, there is often no reason here to provide (galvanic) isolation. Instead, in this case the respective antenna elements or antenna areas concerned can, with certain preconditions, be integrated directly into the signal line: the signal is, so to speak, routed through one antenna element and right on to the next. This results in an array in which two or more antenna elements are connected to one another in the manner of a series circuit.

When an antenna element or antenna area is used as a signal conductor, two connecting lines are connected to the antenna concerned, particularly to regions that are located approximately opposite each other. The one connector then functions as a feed line for the particular antenna element or antenna area concerned, while the other connector forms the feed line to the next connected antenna element or antenna area.

If an antenna segment is connected in the manner of a branch line to a common feed line, then the arrangement is more nearly one of parallel connection of the individual antenna elements or antenna branches.

When an antenna element or antenna patch branches off to one side from a common connecting line, the array can be configured so that the antenna elements or antenna areas branch off from the connecting line alternately in both directions; an arrangement of this kind makes it possible, for example, to connect all the antenna elements of different antenna groups to common feed lines within the very plane of the antenna elements.

Another connection option is to connect one or more antenna elements of the same antenna group to one another by means of vias leading to a common conduction path plane. Preferably a plurality of contact holes are provided for each via, in a well-defined pattern.

Since there is a plurality of antenna groups, a corresponding number of conduction-path layers can be used to form a true signal plane. The vias of antenna elements from different groups then penetrate the multilayer board stack to different depths.

Finally, it is within the teaching of the invention that one or more additional through-holes or vias is/are provided between the vias of different antenna groups, to shield said vias from one another. Where appropriate, such holes can terminate blind at one end, whereas they are connected—preferably by their other end—to a ground terminal that is preferably configured as an additional conduction path layer or area.

Further features, advantages, characteristics and effects based on the invention will become apparent from the following description of a few preferred embodiments of the invention and by reference to the drawing. Therein:

Figure 1:
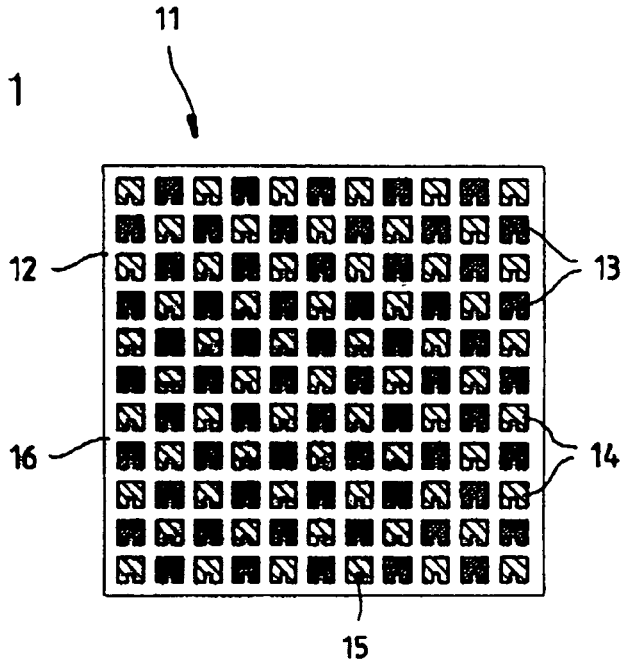
FIG. 1 shows a first, planar radar antenna array in a view perpendicular to its ground plane.

FIG. 1 shows a radar antenna array 11 arranged, in a planar construction, on an (approximately) square circuit board 12. The radar antenna array 1I comprises a multiplicity of antenna areas 13, 14, specifically a total of one hundred and twenty-one. Of these, sixty antenna areas 13, which are shaded dark in FIG. 1, are assigned to a first antenna group, while the other sixty-one antenna areas 14, which are shaded light in FIG. 1, are assigned to a second antenna group.

All the antenna areas 13, 14 have identical (external) dimensions, specifically an (approximately) square basic shape, with a slit to facilitate connection on one base side: in the plan view of FIG. 1, on the bottom edge of the respective antenna area 13, 14. The slit 15 can have different lengths (preferably depending on the position of an antenna area 13, 14), and is used to impedance-match the antenna area 13, 14 concerned. In the case of square antenna areas 13, 14, a slit of this kind serves to give a standing wave a defined orientation, which in the case of rectangular antenna areas is effected merely by virtue of the ratio of the area dimensions to the vibration frequency or vibration wavelength.

The distribution of the antenna areas 13, 14 and their assignment to the two antenna groups follows strictly the same scheme as the division of a checkerboard pattern into white and black fields. Thus, antenna areas 13, 14 of different antenna groups alternate both in the direction of a horizontal row and in the direction of a vertical column, whereas in the diagonal directions, analogously to the arrangement of the fields on a checkerboard, antenna areas 13, 14 of the same antenna group succeed one another.

As will readily be appreciated, the respective centroids of all the antenna areas 13, 14 of each antenna group lie exactly in the center of the circuit board 12, and therefore coincide. Each antenna area 13, 14 is completely isolated on the top 16 of the board from all the adjacent antenna areas 13, 14. This is brought about by mutual spacings that crisscross the top 16 of the board like a rectangular network of alleys or streets.

The contacting of the individual antenna areas 13, 14, i.e., their connection or coupling to a respective connecting line common to each antenna group, takes place on the back of the board 12 and/or within its conductive intermediate layers. For this purpose, in the region of each antenna area 13, 14 there is at least one via that leads to a given intermediate layer of the board 12 or all the way to the back thereof.

For example, a first intermediate layer, which is separated from the top or front side 12 only by a thin, electrically isolating layer, but otherwise follows immediately thereafter, can be designed as a nearly closed, electrically conductive ground layer to completely shield the individual antenna patches or areas 13, 14 from conduction paths laid behind them.

Behind this, and separated from it only by another electrically isolating layer, is another layer of conduction paths that connects solely the antenna areas 13 of a first antenna group to one another and/or to a common connecting line.

Behind this conduction path system connecting the antennas 13, and separated from said conduction path system only by another electrically isolating layer, is, again, a nearly closed intermediate layer configured as an electrically conductive ground layer, which shields the conduction path system connecting antenna areas 13 from the conduction path planes located behind them.

Following this second ground layer, and separated from it only by another electrically isolating layer, is a second conduction path system that connects solely the antenna areas 14 of the second antenna group to one another and/or to a common connecting line.

Behind this, and again separated by an isolating layer, can be disposed a third ground layer, which also shields the second conduction path system against unwanted interference.

The electrical connectors are preferably only two in number: a common connector for the first antenna group and a common connector for the second antenna group.

In contacting the antenna patches 13, 14, care must also be taken to ensure that they vibrate in a predetermined phase relationship to one another. This can be accomplished, for example, by influencing the length of the signal line between two adjacent and interconnected antenna patches 13, 14 of the same antenna group.

To obtain defined signal propagation times, it is helpful, instead of configuring a rearward contact in the first conduction path interlayer as a (largely) closed area, to break it up into as individual, linear conduction paths along which the signals propagate at the speed of light, or in any event at a constant speed. The signal propagation time from one point to another point can thus be precisely determined.

A suitable choice for contacting all the antenna areas 13, 14 of a common antenna group is, for example, a conduction path structure that is branched in a rib-like manner, with a "spine" conductor that extends, for example, in a main diagonal and from which secondary conductors branch off to either side and roughly perpendicular to it, in a rib-like configuration. Such an arrangement has the advantage that all the connections can be made with conduction path segments of in each case equal length. This same length can then be calibrated to the wavelength of the radar frequency concerned. The contacting of an antenna area 13, 14 is preferably done exactly at its center, where the respective slit 15 ends. Thus, the diagonal spacing of the area centers in the diagonal direction of immediately adjacent antenna areas 13, 14 should roughly correspond to the wavelength of the radar frequency concerned. The short vias between this conduction path plane and the antenna plan can generally be neglected in determining the signal propagation time, since this fraction of the propagation time is common to all the vias and thus causes an additional delay of each antenna signal that is the same in each case.

Naturally, a single through-hole filled with an electrically conductive medium, for example tin, is sufficient to effect contacting in each case. However, it has proven effective to provide a plurality of through-holes, possibly of reduced cross section, instead of a single through-hole. This not only reduces the probability of failure, but, most importantly, improves signal quality.

It is further helpful to decouple the vias of different antenna groups from one another. This can be done, for example, by means of additional vias that conduct ground potential and are located between the vias of different antenna groups. The ideal choice for this would naturally be, for example, a sleeve-shaped via that completely surrounds a connecting contact of an antenna. However, a sleeve-shaped via would considerably weaken the stability of a circuit board and thus would again greatly increase the probability of failure. An acceptable compromise is, therefore, for example a ring-shaped arrangement of a relatively large number of roughly punctiform ground vias, each of which surrounds a respective antenna connection via. Another variant provides for arranging such ground vias along all the alleys between the antenna areas 13, 14, since this also substantially reduces crosstalk.

Figure 2:
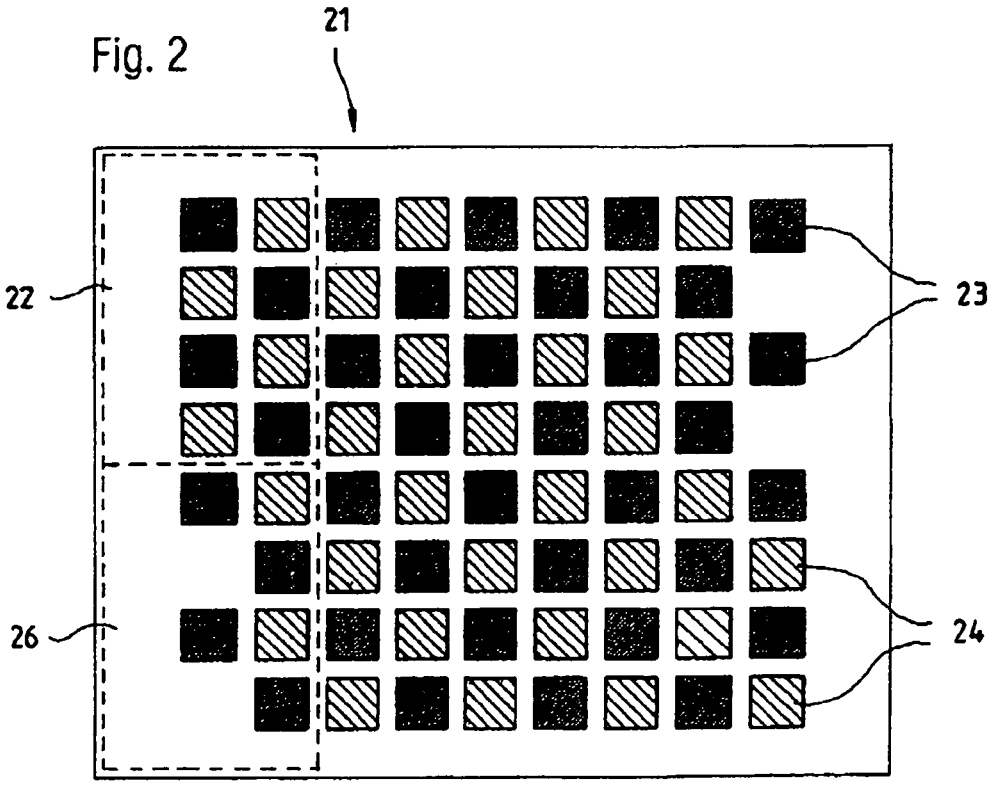
FIG. 2 shows another radar antenna array in a view corresponding to that of FIG. 1.

Radar antenna array 21 according to FIG. 2 differs from radar antenna array 11 of FIG. 1 in that in this case, among other things, the circuit board 22 is not square, but rectangular.

This is a result primarily of the fact that the number of rows and the number of columns in the antenna grid are not the same in this case. Instead, there are nine columns, but only eight rows. Furthermore, not all of the seventy-two spaces in this 8×9 matrix are occupied by antennas 23, 24; only sixty-eight spaces are, there being two antenna areas 24 missing from the outermost lateral columns in both the upper right and lower left quadrants.

Furthermore, radar antenna array 21 according to FIG. 2 includes three, rather than two, antenna groups. This is achieved by means of the following circuitry.

Whereas all the antenna areas 23 that are densely shaded in FIG. 2 are interconnected to form a single antenna group or are coupled together in some other way, this is not true of the interlacedly arranged antenna areas 24. Of these, although antenna areas 24*a* in the upper half of the radar antenna array 21 are connected to one another, they are not connected to antenna areas 24*b*—which, for their part, are coupled to one another—in the bottom half of the radar antenna array 21, with the result that there is an upper antenna group comprising antenna areas 24*a* and a lower antenna group comprising antenna areas 24*b*, interlaced, in each case, with antenna areas 23 distributed over the entire area of the radar antenna array 21.

One advantage of this arrangement is that the spatial offset makes it possible to perform angle measurements based on the monopulse principle. To this end, the antenna groups comprising antenna areas 24*a* and 24*b* are operated as receiving antennas. As can be seen from FIG. 2, the centroids of the aggregate of all the antennas 24*a*, 24*b* in each of these antenna groups are offset from one another in the horizontal direction. For example, the centroid of antennas 24*a* of the upper antenna group is approximately one grid space to the left of the centroid of antennas 24*b* of the lower antenna group; the offset with respect to the centroid of the transmitting antenna comprising antenna areas 23 is half a grid space to the left or the right, as the case may be. In this way, the receive signals of both groups of receiving antennas can be used to make conclusions regarding the lateral deviation angle with respect to a reflecting object.

Figure 3:
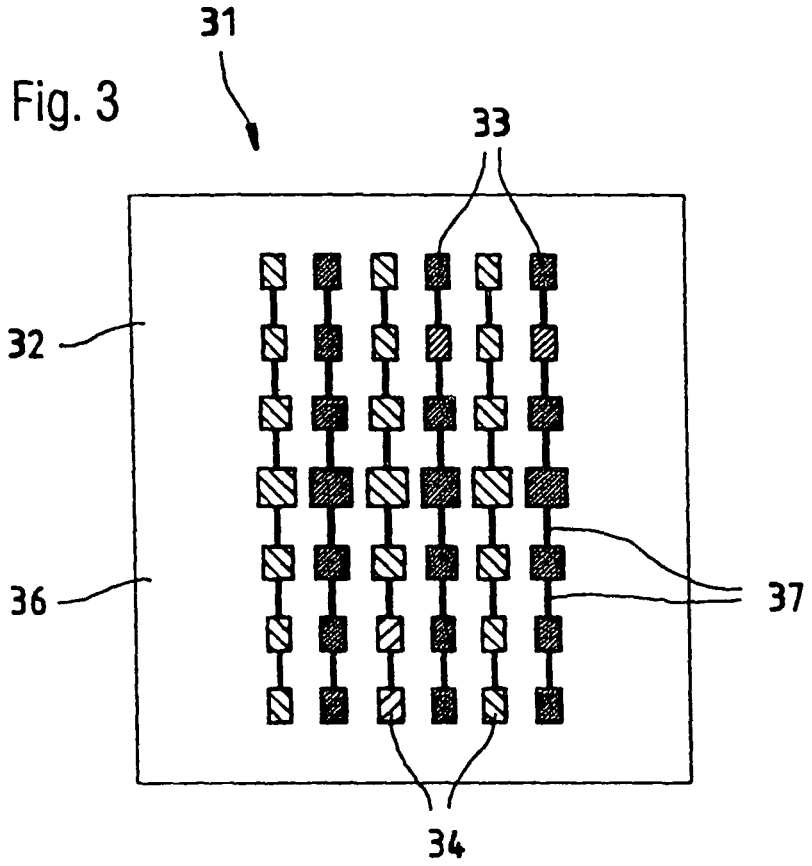
FIG. 3 shows a further-modified embodiment of the invention in a view according to FIG. 1.

Radar antenna array 31 according to FIG. 3 deviates from the checkerboard pattern principle. Here again, as in the previously described embodiments 11, 21, a multilayer circuit board 32 is used as the substrate for a multiplicity of antenna areas 33, 34. However, antenna areas 33, 34 are not arranged in a checkerboard pattern but in vertical columns, each containing a plurality, particularly seven, antenna areas 33, 34, all the antennas 33, 34 in a column being assigned to the same antenna group. The antennas 33, 34 in adjacent rows are assigned to the two antenna groups in alternation. Hence, in this case there is no two-dimensional interlacing, as in the case of the checkerboard pattern, but only one-dimensional interlacing.

In the exemplary embodiment shown, there is a total of six columns for every seven antenna areas 33, 34, thus forty-two antenna areas 33, 34 in all. Of these, twenty-one antennas 33, 34 are assigned to the first antenna group and an equal number to the second antenna group.

The antenna areas 33, 34 of each antenna group that are collected in one column are connected to one another galvanically on the front 36 of the circuit board by narrow conduction paths 37; together with a first ground layer disposed directly under the topmost isolating layer, this results in a microstrip conductor structure having a defined wave resistance.

The conduction paths 37 preferably each run centrally within a column and rectilinearly, vertically from bottom to top. Their length is therefore equal to the (vertical) distance between the vertically adjacent antenna areas 33, 34. By the same token, this length of a conduction path segment 37 is roughly identical to the extent of an antenna area 33, 34 measured in the lengthwise direction of the column, i.e., in the representation of FIG. 3, the height of antenna rectangle 33, 34. This, in turn, corresponds to approximately half the wavelength of the radar frequency used. The reason for this is as follows: expanding the antenna rectangle by the order of magnitude of one half wavelength makes it possible to form a standing wave with two nodes at the (electrically) reflective edges of the antenna areas 33, 34. By the same token, the distance from the connection point or infeed point of one antenna area 33, 34 to the corresponding connection point or infeed point of the adjacent antenna area 33, 34 corresponds overall to approximately one whole wavelength of the radar frequency used. The mutually galvanically coupled antenna areas 33, 34 are thus excited to vibrate in phase, i.e., a received vibration is added in the proper phase.

Columns assigned to the same antenna group are connected to one another on the back of the circuit board 32 or in an intermediate layer thereof, for which purpose vias are necessary. Their structure and other details, for example their mutual shielding, etc., can be patterned after the solutions used in embodiments 11 and 21.

Antenna array 31 has another peculiarity, however: whereas the antenna extent measured in the longitudinal direction of a column is approximately equal for all the antenna areas 33, 34, corresponding to approximately half the wavelength of the radar frequency used, the antenna extent measured transversely to the longitudinal direction of a column is not constant within a column. Instead, within each column, this dimension is greatest at the respective central antenna area 33, 34 and decreases continuously toward the upper and lower ends of the column.

Whereas the antenna dimension that extends in the vibration direction determines the wavelength of a standing wave, and thus the resonance frequency of the particular antenna area 33, 34, the antenna dimension extending transversely thereto is a measure of the impedance of the antenna area 33, 34, and thus of the radiated power or the reception field strength. The wider antenna areas 33, 34 or antenna patches in the center have a lower impedance and thus a higher radiation amplitude than the narrower antenna areas 33, 34 or antenna patches at the top and bottom ends of an antenna column. Thus, having the radiation power or reception field strength decrease steadily or smoothly toward both the top and the bottom edge of the radar antenna array 31 has the effect of reducing or even eliminating side maxima in the directional characteristic of the antenna pattern.

Figure 4:
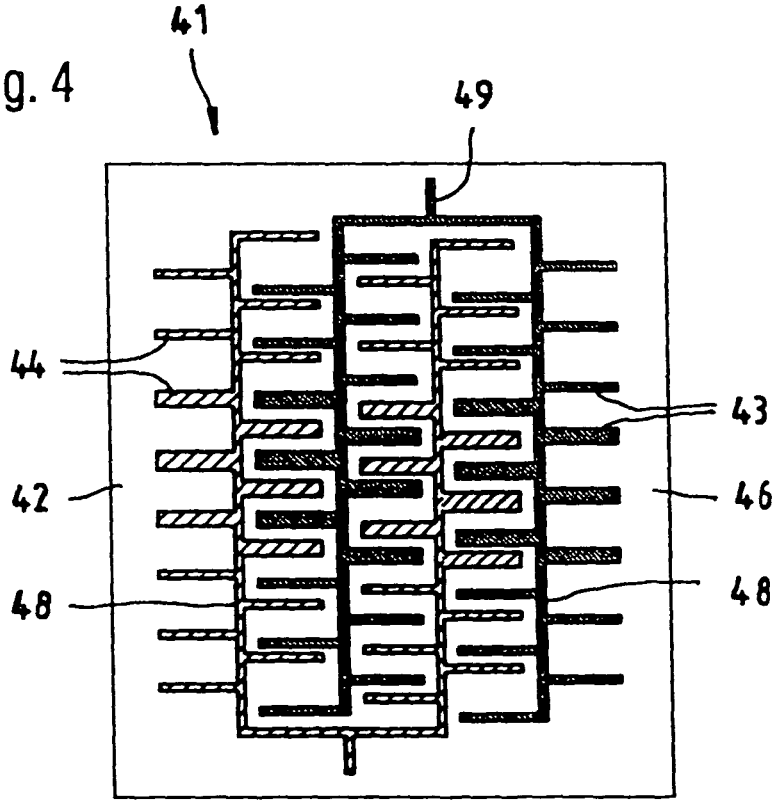
FIG. 4 shows a fourth embodiment of the invention in a representation according to FIG. 1.

Finally, FIG. 4 shows a still more complex radar antenna array 41. This embodiment bears some resemblance to the array 21 of FIG. 2. A multiplicity of antenna areas 43, 44, each assigned to a respective one of two different antenna groups, is disposed on a substrate in the form of a rectangular circuit board 42. Here again, this is fundamentally a checkerboard pattern, with the antenna areas 43, 34 [numeral sic] arranged in five columns and a maximum of sixteen rows; however, each row always contains only four antenna areas 43, 44, resulting in a total of sixty-four antenna areas 43, 44. Of these, thirty-two antenna areas forty-three belong to a first antenna group and forty-four antenna areas to the other antenna group.[2]

[2] Translator's Note: Sic, with the numerals spelled out. The intention was undoubtedly: "Of these, thirty-two antenna areas 43 belong to a first antenna group and thirty-two antenna areas 44 to the other antenna group."

Eight antenna areas 43, 44 in each column are arranged in[3] one respective antenna group. The total of sixteen antenna areas 43, 44 of one antenna group that are located in two immediately adjacent columns are connected to a single connecting line 48, which extends on the top 46 of the circuit board 42, in each case along the butt joint between the two adjacent columns. The antenna areas 43, 44 connected to it branch off the connecting line 48 laterally at right angles in the form of branch lines, one to the right and the next to the left, in alternating sequence.

[3] Translator's Note: "Assigned to" may have been intended, since the difference in the German words is only a matter of a prefix (angeordnet vs. zugeordnet).

Each branch line or antenna area 43, 44 has the same length, which is dimensioned to correspond to approximately half the wavelength of the radar frequency used, or a multiple thereof, for example one whole wavelength. The distance between two adjacent connecting lines 48—each of which is assigned to a different antenna group—is greater than the length of the branch lines or antenna areas 43, 44, such that each branch line or antenna area 43, 44 is connected to only one connecting line 48, which is the element that determines the assignment of the particular antenna area 43, 44 or branch line to one or the other antenna group.

All the connecting lines 48 of a common antenna group are bundled together in the region of an end face of the circuit board 42 and serve as a common connector 49. In this embodiment, the bundled lines and the connectors 49 themselves are also disposed on the top 46 of the circuit board 42.

An additional inventive idea is realized in this radar antenna array 41: although all the branch lines/antennas 43, 44 have the same length, so that they can be tuned to the same radar frequency, the width of the branch lines/antenna areas 43, 44 varies: specifically, the branch lines/antenna areas 43, 44 that are roughly in the middle of each column, i.e., in the region of an "equator," have the largest width; from there outward, the width of the branch lines/antenna areas 43, 44 decreases toward the top and bottom edges, or "poles," of the radar sensor [sic] array 41. The reasoning here is similar to that of the embodiment 31 according to FIG. 3: because the impedances of the branch lines antenna areas 43, 44 increase toward the poles, their radiation power or reception field strength decreases continuously toward the poles. This causes the radiation power to vary smoothly across the surface 46 of the circuit board to its edges, and thus prevents side maxima in the patterns of the antenna groups of the radar antenna array 41.

The individual antenna elements 13, 14; 23, 24; 33, 34; 43, 44 are arranged in a common, especially planar surface in a mutually interlaced manner along at least one direction within or tangential to this common surface, whereby along such interlacing direction unintermediate consecutive (following) antenna elements 13, 14; 23, 24; 33, 34; 43, 44 of different antenna groups alternate, and whereby for each antenna group there exists at least one antenna element 13, 14; 23, 24; 33, 34; 43, 44, which is flanked in each interlacing direction by at least two equally spaced antenna elements 13, 14; 23, 24; 33, 34; 43, 44 of another antenna group as well as by at least two antenna elements 13, 14; 23, 24; 33, 34; 43, 44 of the same antenna group spaced equally among themselves. In this way, a high degree of interlacing is achieved, which reduces or avoids harmonics or side peaks or side lobes of the antenna diagram.

What is claimed is:

1. A radar antenna array for a medium to long range radar sensor, the array comprising a first antenna group having a plurality of individual, mutually coupled antenna elements and a second antenna group having a plurality of individual, mutually coupled antenna elements, the individual antenna elements of different antenna groups being not galvanically connected to one another, but being arranged in a common planar area and in a mutually interlaced manner, wherein a) said first and said second antenna groups are each assigned its own HF receiver module, to which connectors of the respective mutually coupled antenna elements of a particular antenna group are permanently connected, wherein said antenna groups are adapted to be operated simultaneously as receiving antennas, b) whereby the antenna elements of both antenna groups are disposed on a first side of a flat substrate, on a second side of which both of the HF receiver modules are disposed, c) and whereby an intermediate layer, comprising substantially closed, electrically conductive layer, is disposed between the first and the second sides of the flat substrate, d) and whereby the contacting of the individual antenna elements, namely their connection or coupling to a respective connecting line common to each antenna group, takes place on the back of the board and/or within its conductive intermediate layers, e) for which purpose, there is at least one via in the region of each antenna element that leads to a given intermediate layer of the board or all the way to the back thereof.

2. The radar antenna array in accordance with claim 1, wherein at least one antenna element which is located at a periphery of an antenna group and whose consumed and radiated transmission power, or captured and relayed reception power, is at least 15% lower than the transmission power consumed and radiated, or the reception power captured and relayed, by an antenna element in the region of the centroid of the antenna group concerned.

3. The radar antenna array in accordance with claim 2, wherein the mutually interlaced antenna elements are arranged in a selected surface pattern.

4. The radar antenna array in accordance with claim 2, wherein said first and second antenna groups are each assigned its own HF transmitter module and/or HF receiver module, wherein said first and second antenna groups are adapted to be operated simultaneously.

5. The radar antenna array in accordance with claim 4, wherein said first and second antenna groups are each assigned its own HF receiver module, thereby adapting both of said antenna groups to be operated simultaneously as receiving antennas.

6. The radar antenna array in accordance with claim 4, wherein the connectors of the respective mutually coupled antenna elements of both of said antenna groups are permanently connected, without a changeover switch, to the HF transmitter module and/or HF receiver module assigned thereto.

7. The radar antenna array in accordance with claim 1, wherein a selected one of said first antenna group and said second antenna group has the narrowest directional characteristic, taking as the width of the directional characteristic a 3 dB bandwidth of a selected antenna pattern, and wherein the total area of the mutually interlaced antenna groups is generally equal to space occupied by the antenna group having the narrowest directional characteristic.

8. The radar antenna array in accordance with claim 1, wherein selectivity between antenna groups is at least 20 dB.

9. The radar antenna array in accordance with claim 1, wherein successive antenna elements of different antenna groups alternate along a spatial direction.

10. The radar antenna array in accordance with claim 9, wherein successive said antenna elements of different antenna groups alternate along each of two different spatial directions.

11. The radar antenna array in accordance with claim 10, wherein the two spatial directions, in each of which successive antenna elements alternate, extend generally perpendicular to each other.

12. The radar antenna array in accordance with claim 1, wherein mutually interlaced antenna elements are arranged in a checkerboard pattern, such that the antenna elements of said first antenna group are placed at locations occupied by white fields on the checkerboard pattern, whereas the antenna elements of said second antenna group are placed at locations occupied by black fields on the checkerboard pattern.

13. The radar antenna array in accordance with claim 12, wherein a plurality of fields of the checkerboard pattern are not occupied by antenna elements.

14. The radar antenna array in accordance with claim 1, wherein all of the antenna elements are disposed on a planar substrate.

15. The radar antenna array in accordance with claim 1, wherein all of the antenna elements of said first and second antenna groups comprise antenna areas and/or planar antennas and/or antenna patches.

16. The radar antenna array in accordance with claim 15, wherein said antenna patches of the first and second antenna groups each present a selected one of a rectangular, square, hexagonal and polygonal area.

17. The radar antenna array in accordance with claim 15, wherein of said antenna patches of said first and second antenna groups each presents an area in the shape of a selected one of an irregular hexagon and a circle.

18. The radar antenna array in accordance with claim 17, wherein said antenna patches of said first and second antenna groups are each adapted to oscillate electrically in a same manner and orientation, and wherein said patches are linearly polarized in the same spatial direction, or are circularly polarized.

19. The radar antenna array in accordance with claim 15, wherein the areas of two of said antenna patches are of the same size.

20. The radar antenna array in accordance with claim 15, wherein consumed and radiated transmission power, or captured and relayed reception power, of said antenna patches decreases continuously from a center of a particular antenna group, particularly from its centroid, to its periphery along a selected one of one spatial direction and every spatial direction within the area.

21. The radar antenna array in accordance with claim 20, wherein said antenna patches of said first and second antenna groups are disposed such that the consumed and radiated transmission power, or captured and relayed reception power, of said antenna patches of said first and second antenna groups decreases approximately along a cosine or cosine$^2$ curve from a centroid of the respective antenna group to the periphery thereof along every spatial direction, a zero point of an argument of said curve for a selected one of said first and second antenna groups being located at the centroid of the antenna group selected.

22. The radar antenna array in accordance with claim 20, wherein an area of one of said antenna patches of a selected one of said first and second antenna groups is designed smaller than an adjacent antenna patch of the respective antenna group, starting from the centroid of the respective antenna group, to the periphery thereof along every spatial direction, in a linear manner or generally along a cosine or cosine$^2$ curve.

23. The radar antenna array in accordance with claim 22, wherein a width of one of said antenna patches of a selected one of said first and second antenna groups, measured transversely to a direction of electrical oscillation thereof, is smaller than a width of an adjacent antenna patch of the respective antenna group, starting from the centroid of the respective antenna group, to the periphery thereof along every spatial direction, decreasing in a linear manner or generally along a cosine or cosine$^2$ curve.

24. The radar antenna array in accordance with claim 23, wherein a power delivered to, or tapped by, one of said antenna patches of a selected one of said first and second antenna groups is smaller than a power delivered to, or tapped by, an adjacent antenna patch of the respective antenna group starting from the centroid of the respective antenna group, to the periphery thereof along every spatial direction, decreasing in a linear manner or approximately along a cosine or cosine$^2$ curve.

25. The radar antenna array in accordance with claim 24, wherein a connector of at least one of said antenna patches of a selected one of said first and second antenna groups in the region of the periphery of the respective antenna group is displaced to a greater extent relative to the edge circumscribed by the area of said antenna patch than is a connector of said antenna patch in the interior of said respective antenna group relative to the edge that is circumscribed.

26. The radar antenna array in accordance with claim 24, wherein the power delivered to, or tapped by, one of said antenna patches of a selected one of said first and second antenna groups is reduced toward one of said antenna patches of the respective antenna group at the periphery by means of beam splitters in a feed network, according to a ratio of mutually different wave resistances present in different branches of the feed network.

27. The radar antenna array in accordance with claim 24, wherein power delivered to, or tapped by, one of said antenna patches of a selected one of said first and second antenna groups is reduced by means of $\lambda/4$ transformers and/or resistances in specific branches of a feeding or tapping network leading to the peripheral antenna patches.

28. The radar antenna array in accordance with claim 15, wherein the longitudinal extents of two of said antenna patches in at least one common spatial direction are equal.

29. The radar antenna array in accordance with claim 15, wherein adjacent antenna patches are spaced apart from one another by at least $\lambda/8$, for electrical decoupling.

30. The radar antenna array in accordance with claim 29, wherein said antenna patches of a common antenna group are spaced apart from one another by approximately the wavelength of an emitted, or sensed, radar signal, or a multiple thereof.

31. The radar antenna array in accordance with claim 15, wherein two said antenna groups are provided with an antenna offset in a generally horizontal direction, with a distance between the two antenna centroids of all of the antenna patches, in each of said antenna groups, that is smaller than a total extent of the antenna group having the widest directional characteristic in the spatial direction concerned, the width of the directional characteristic being the 3 dB beamwidth of the particular antenna pattern.

32. The radar antenna array in accordance with claim 31, wherein the distance d between the two antenna centroids of all of said antenna patches in two antenna groups is no more than the wavelength $\lambda$: $0<d\leqq\lambda$.

33. The radar antenna array in accordance with claim 15, wherein a plurality of said antenna patches are connected at a point between a center and a periphery of an area circumscribed by a selected antenna element, either by means of a pathway to the point or in a region of an inwardly directed recess in a circumscribed area of a selected antenna patch.

34. The radar antenna array in accordance with claim 15, wherein said antenna elements in the same antenna group are galvanically coupled to one another.

35. The radar antenna array in accordance with claim 34, wherein one or more rows of said antenna patches in the same antenna group are connected to one another in the antenna plane.

36. The radar antenna array in accordance with claim 35, wherein pathways to different antenna groups and/or to different HF receiving parts, are shielded from one another.

37. The radar antenna array in accordance with claim 36, wherein one or more additional pathways is/are provided between the pathways of different antenna groups, to shield the pathways from one another.

38. The radar antenna array in accordance with claim 15, wherein said antenna patches are connected to one another in a series circuit.

39. The radar antenna array in accordance with claim 15, wherein two connecting lines are connected to at least one antenna patch in regions that are disposed generally opposite to each other.

40. The radar antenna array in accordance with claim 15, wherein at least two of said antenna patches are interconnected in a parallel circuit.

41. The radar antenna array in accordance with claim 40, wherein one antenna patch branches off to one side from a common connecting line.

42. The radar antenna array in accordance with claim 41, wherein antenna patches that branch off successively from a common connecting line extend in different, non-parallel directions, as viewed from the connecting line.

* * * * *